United States Patent [19]

Takahashi

[11] 4,070,081

[45] Jan. 24, 1978

[54] COUPLING MECHANISM FOR MALE AND FEMALE CONNECTORS

[75] Inventor: Toru Takahashi, Yokohama, Japan

[73] Assignee: Yamaichi Electric Mfg., Co., Ltd., Tokyo, Japan

[21] Appl. No.: 727,379

[22] Filed: Sept. 27, 1976

[30] Foreign Application Priority Data

Oct. 13, 1975 Japan ..... 50-139238[U]

[51] Int. Cl.[2] ..... H01R 13/54

[52] U.S. Cl. ..... 339/91 R; 361/399

[58] Field of Search ..... 339/75 R, 75 M, 91 R; 317/101; 361/399, 413, 415

[56] References Cited

U.S. PATENT DOCUMENTS

| | | | |
|---|---|---|---|
| 2,987,693 | 6/1961 | Wamsley | 339/91 R |
| 3,150,906 | 9/1964 | Chambon et al. | 339/91 R X |
| 3,853,379 | 12/1974 | Goodman et al. | 339/91 R X |
| 3,993,390 | 11/1976 | Eigenbrode | 339/91 R |

*Primary Examiner*—Joseph H. McGlynn
*Assistant Examiner*—E. F. Desmond
*Attorney, Agent, or Firm*—Wenderoth, Lind & Ponack

[57] ABSTRACT

This invention relates to a coupling mechanism for connecting a male connector provided with plural male terminals and a female connector provided with plural female terminals, and is featured by a pair of defining plates for defining the coupling position of the female connector, lock means for assuring a complete coupling between the connectors and female connector lifting means for facilitating decoupling of the connectors, the lock means and the female connector lifting means being composed as a pair of swinging levers thereby facilitating the coupling and decoupling of the male and female connectors.

2 Claims, 6 Drawing Figures

COUPLING MECHANISM FOR MALE AND FEMALE CONNECTORS

BACKGROUND OF THE INVENTION

In coupling a male connector containing plural male terminals with a female connector containing plural female terminals, the conventional coupling method wherein the coupling is maintained principally by the frictional coupling force between said male and female termianls is unable to provide sufficiently high coupling strength and may give rise to loose coupling or complete decoupling of the connectors when the connecting wire is subjected to a tensile force or the connectors are subjected to an external force or a shock. Also when the female connector is fitted into the male connector, the lack of means for effectively defining the fitting position may lead to erroneous connections resulting from incorrect positioning. Furthermore, the conventional connectors, wherein the coupling force between the male and female terminals is made as high as possible in order to ensure satisfactorily strong coupling between the male and female connectors, have generally very poor detachability and are very difficult to disconnect manually.

SUMMARY OF THE INVENTION

In case of coupling a male connector containing plural male terminals with a female connector containing plural female terminals, an incorrect mutual positioning cannot provide connections between the male and female terminals in correctly corresponding relations and may eventually lead to erroneous connections. The principal object of the present invention is to avoid such inconvenience and to provide a coupling mechanism of the male and female connectors wherein the female connector, when fitted into the male connector, is guided into a correct position by means of a pair of defining plates provided on said male connector, whereby it is rendered possible to realize a correct connection between the male and female terminals in one operation.

Also the structure wherein the coupling between the male connector and female connector is maintained principally by the tight coupling force between the plural male and female terminals is apt to cause decoupling of the connectors or to form play therein with resulting incomplete connections when the connecting wires for example are subjected to an external tensile force. An another object of the present invention, therefore, is to provide a coupling mechanism for the male and female connectors provided with an effective means capable of stably maintaining the connections even under the effect of mechanical shock or other external forces. This is achieved by a lock mechanism capable of securely maintaining the coupled state of connectors by means of a simple single operation of a pair of levers.

Furthermore, if the male and female terminals are coupled excessively tight or are provided with an alternative coupling means in order to increase the coupling force between the male and female connectors and to avoid involuntary decoupling thereof, such increased coupling force will render manual decoupling of connectors extremely difficult. Another object of the present invention, therefore, is to provide a coupling mechanism for male and female connectors provided with a female connector lifting means which releases the locking of connectors and simultaneously lifts the female connector to facilitate the decoupling thereof by means of a simple single operation of said pair of levers.

Still further objects and advantages of the present invention will be made clear from the following description.

The present invention relates to a coupling mechanism for a male connector provided with plural male terminals to be connected with a printed circuit board or the like and a female connector provided with plural female terminals to be fitted with said male terminals.

Now the present invention will be explained in detail with respect to an embodiment thereof while referring to the attached drawings.

DRAWINGS

DESCRIPTION OF PREFERRED EMBODIMENT

Figure 1:
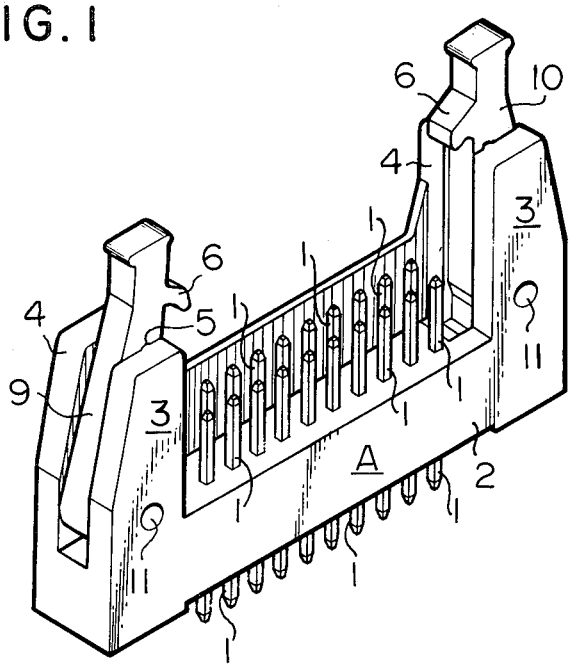
FIG. 1 is a perspective view of the male connector.

Now referring to the attached drawings, A is a male connector provided on the base plate 2 having a plurality of male terminals 1 vertically penctrating through said base plate 2, and B is a female connector provided with a plurality of female terminals (not illustrated) to be coupled with said male terminals. Said male connector A is provided with a pair of vertical defining plates 3, 4 provided symmetrically on both sides of said base plate 2. Said female connector B is inserted between said pair of defining plates 3, 4 and is guided to the correct coupling position of said male and female terminals while the position of both ends of said female connector B is defined by the internal faces of said defining plates 3, 4.

Levers 9 and 10 are rotatably mounted respectively on said defining plates 3, 4 by means of shafts 11.

Each of said defining plates 3, 4 is composed of two parallel plate members provided on both sides of said base plate with a small distance therebetween, and said levers 9 and 10 are respectively mounted between said two parallel plate members so as to be rotatable in lateral direction around said shafts 11 between a closed position and an opened position.

Figure 3:
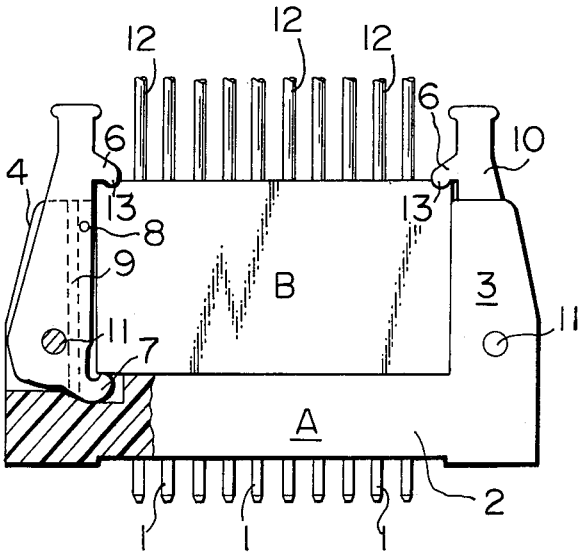
FIG. 3 is a partially cut-off elevational view of the male and female connectors after the completion of coupling thereof.
Figure 5:
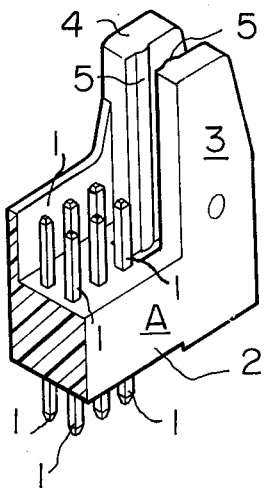
FIG. 5 is a perspective view of a part of the male connector.

Said levers 9, 10 are respectively provided on the upper inner face thereof with latches 6, 6 which engage with the upper shoulder portions of said female connector B in the coupled state thereof with the male connector A when said levers 9, 10 are rotated to closed position as illustrated in FIG. 3, thereby locking the male and female connectors in the coupled state thereof. The locking is released when said levers 9, 10 are rotated to their open position as illustrated in FIG. 4.

The upper shoulder portions of said female connector B are provided with engaging recesses 13, 13 to accomodate the latches 6,6 of said levers 9, 10, and said latches 6, 6 of the levers 9, 10 are so structured as to be forcefully fitted into said recesses 13, 13 by pressing the levers 9, 10 to the closed position, thereby preventing involuntary unlocking. Also the parallel plate members constituting the defining plate 3 or 4 are respectively provided on the internal faces thereof with vertical protruding ridges 5, 5 while each lever 9 or 10 is provided on both side faces thereof with protruding portions 8, 8 which engage with the protruding ridges 5, 5 when the latch 6 is brought into engagement with the recess 13 of the female connector B, thereby realizing an additional locking of the lever 9 or 10 against the defining plate 3 or 4. The locking of the levers 9, 10 themselves prevent the rotation thereof to the opened position and effectively maintains the latches 6, 6 in above-mentioned locked state thereof.

Figure 4:
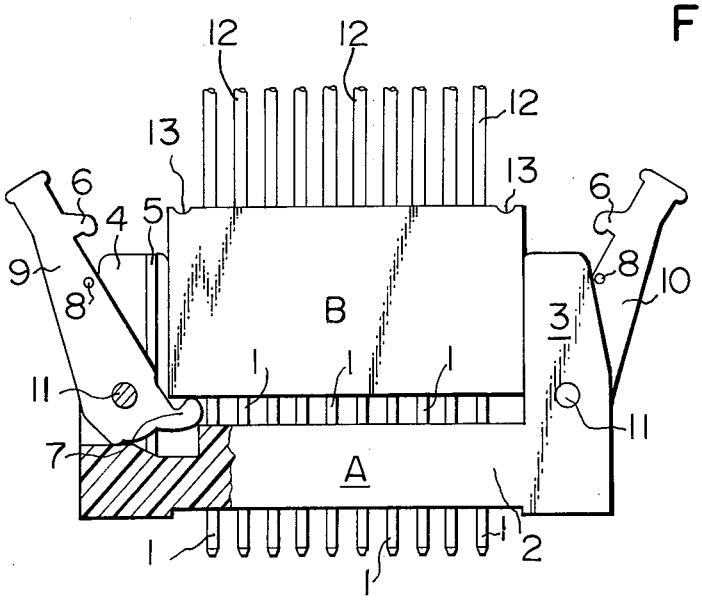
FIG. 4 is a partially cut-off elevational view of the male and female connectors prior to the decoupling thereof.
Figure 6:
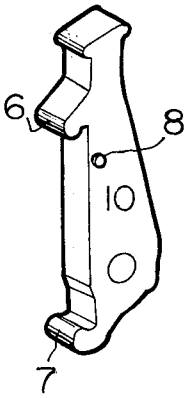
FIG. 6 is a perspective view of a lever.

Further, the levers 9, 10 are respectively provided on the lower inner surfaces thereof with lifting fingers 7, 7, which are in a stand-by state in contact with the bottom surface of the female connector B when the levers 9, 10 are in the closed and locked state as illustrated in FIG. 3, while the lifting fingers lift the female connector B to cause decoupling thereof from the male connector A when the levers 9, 10 are rotated to the unlocked opened position as illustrated in FIG. 4. During decoupling the female connector B is smoothly guided by the defining plates 3, 4. The present invention is advantageously applicable, therefore, to the coupling mechanism between a male connector provided with a plurality of male connecting rods to be connected for example with a printed circuit board 14 and a female connector provided with a plurality of connecting wires.

Figure 2:
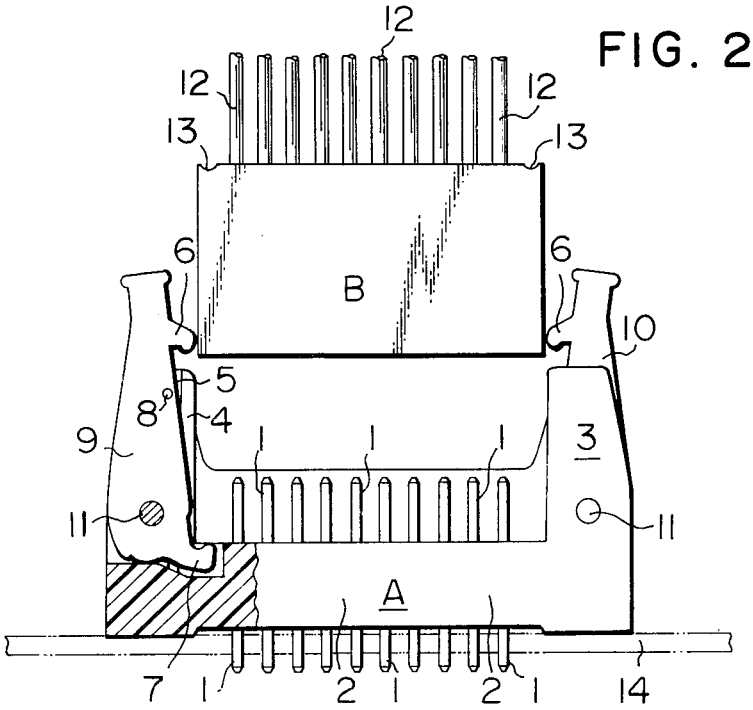
FIG. 2 is a partially cut-off elevational view of the male and female connectors prior to the coupling thereof.

In order to couple the female connector with the male connector of the present invention, the levers 9, 10 are slightly rotated toward the opened position thereof around the shafts 11 as illustrated in FIG. 2 to cause the latches 6, 6 to escape outwardly, and, in this state, the female connector B can be easily fitted into the male connector A. Upon completion of satisfactory coupling, the levers 9, 10 on both sides are returned to the closed position as illustrated in FIG. 3. In this state said latches 6, 6 are forcedly brought into engagement with the recesses 13, 13 on the upper surface of said female connector B, and simultaneously the protruding portions 8, 8 of the levers 9, 10 engage the inside of the protruding ridges 5, 5 of the defining plates 3, 4 to prevent lateral and upward movement of the female connector B, thereby effectively maintaining the coupling between the male and female connectors A, B and preventing involuntary decoupling of the female connector B from the male connector A.

In order to detach the female connector B from the male connector A, the levers 9, 10 are outwardly rotated as illustrated in FIG. 4, to cause the disengagement of the latches 6, 6 from the recesses 13, 13 of the female connector B and of the protruding portions 8, 8 from the protruding ridges 5, 5 and simultaneously to slightly lift the female connector B by means of the lifting fingers 7, 7, thereby facilitating the extraction of the female connector B from the male connector A.

What is claimed is:

1. A coupling mechanism for a male connector and a female connector, said mechanism comprising:

a male connector having:

a base portion;

a plurality of male terminals extending upward from said base portion;

a pair of vertical spaced end plates symmetrically positioned at each end of said base;

a female connector having a plurality of female terminals removably positioned over said male terminals on said base between said pairs of vertical, spaced end plates and having indentations on the upper surface thereof adjacent said end plates;

a lever means rotatably mounted between each pair of end plates engagable with said indentations on said female connector for locking said female connector to said male connector and for lifting said female connector away from said male connector, said lever means comprised of:

a pair of levers opposite each other pivotably mounted between said end plates and rotatable in opposite directions, engaging latches at the upper inner surface of each lever engagable with said indentations in the top surface of said female connector when said lever is rotated toward said female connector, whereby said female and male connector are locked together, and lifting fingers at the bottom end of each lever beneath said female connector when said female and male connectors are locked together, whereby rotating said lever causes said engaging latches to move away from the top surface of said female connector, thereby unlocking said connectors, and whereby the rotation of said lever causes said lifting fingers beneath said female connector to force said female connector away from said male connector.

2. A mechanism as claimed in claim 1, further comprising:

a pair of vertical protruding ridges opposing each other on the inside surface of each pair of end plates, and protrusions on said lever members engagable with said vertical protruding ridges when said lever is rotated toward said female connector and said female connector is locked thereby, whereby said lever member is locked in position by said protruding ridges.

* * * * *